US006681871B2

(12) United States Patent
Drumm et al.

(10) Patent No.: US 6,681,871 B2
(45) Date of Patent: Jan. 27, 2004

(54) AUGER TOOL FOR BORING

(76) Inventors: Arthur E. Drumm, 14808 Hillview Rd., Marysville, OH (US) 43040; Thomas B. Mash, 3019 Emory Rd., Knoxville, TN (US) 37938

( * ) Notice: Subject to any disclaimer, the term of this patent is extended or adjusted under 35 U.S.C. 154(b) by 70 days.

(21) Appl. No.: 10/126,313

(22) Filed: Apr. 19, 2002

(65) Prior Publication Data

US 2003/0196834 A1 Oct. 23, 2003

(51) Int. Cl.[7] ..... E21B 7/26; E21B 10/44; B27G 15/00

(52) U.S. Cl. ..... 175/19; 175/323; 175/325.2; 175/394; 408/226

(58) Field of Search ..... 175/19, 20, 323, 175/325.2, 388, 394, 395; 408/223, 224, 225, 226, 227, 230, 241 R, 710

(56) References Cited

U.S. PATENT DOCUMENTS

| | | | | |
|---|---|---|---|---|
| 1,993,365 A | | 3/1935 | Englebright et al. | |
| 2,221,680 A | | 11/1940 | Parrish | |
| 3,710,877 A | | 1/1973 | Michasiw | |
| 5,487,432 A | * | 1/1996 | Thompson | 175/20 |
| 5,782,310 A | | 7/1998 | Lange | |
| 6,089,334 A | * | 7/2000 | Watts | 175/394 |
| 6,161,631 A | | 12/2000 | Kennedy et al. | |
| 6,168,350 B1 | * | 1/2001 | Bartlett | 405/240 |
| 6,283,231 B1 | | 9/2001 | Coelus | |
| 6,308,789 B1 | | 10/2001 | Kuenzi et al. | |

* cited by examiner

*Primary Examiner*—David Bagnell
*Assistant Examiner*—Brian Halford
(74) *Attorney, Agent, or Firm*—Jason H. Foster; Kremblas, Foster, Phillips & Pollick

(57) ABSTRACT

A tool for boring has a first shaft for drivingly linking at a first end to a portable rotatable machine. At a second end, the tool has a fastener to which a modular auger section can be drivingly linked. A second shaft of the tool has an outer surface to which a radially inwardly extending edge of a helical flight is attached. A cylindrical collar is attached to a radially outwardly extending peripheral edge of the flight and is mounted radially outwardly of the second shaft. An insulator interposed between the shafts electrically insulates the shafts from each other. The shafts can be unlinked through a shear pin breaking in response to a predetermined amount of relative torque to the shafts.

28 Claims, 5 Drawing Sheets

AUGER TOOL FOR BORING

CROSS-REFERENCES TO RELATED APPLICATIONS (Not Applicable)

STATEMENT REGARDING FEDERALLY-SPONSORED RESEARCH AND DEVELOPMENT (Not Applicable)

REFERENCE TO AN APPENDIX"

(Not Applicable)

BACKGROUND OF THE INVENTION

1. Field of the Invention

This invention relates generally to excavating tools, and more particularly to earth-drilling augers used for boring through particulate material beneath a surface structure, such as a sidewalk or a foundation.

2. Description of the Related Art

Forming a hole in particulate material, such as soil or sand, under a surface structure is usually effected by a screw-like tool called an auger, which progressively bores or drills into the material. The typical auger has a cutting blade at the distal end of a helical flight that is mounted to an axle. The axle extends longitudinally away from the user, or a rotatable machine, and defines an axis of rotation for the auger. The user rotates the auger, either by hand, or more preferably by the machine. As the auger progressively forms the hole, additional sections of helically flighted axles can be coupled to the auger.

Some prior art augers and drilling tools that are designed for drilling into compacted earth, such as clay, combine pressurized air and working fluid with the auger for continuously loosening debris from the hole. The fluid and debris are channeled into an escape route sub-assembly system, which is typically a longitudinal hole through the axle. In this way, the hole is regularly flushed and kept relatively clean to enable the inner surface of the hole to be dissociated by the drilling action. However, such prior art drilling tools are bulky and awkward due to the attached pneumatic and hydraulic hoses, so they are difficult to maneuver and operate, especially when they are used in narrow spaces. In addition, the escape route sub-assembly system can become clogged with debris, which can damage the tool and delay the overall progress of an operation. Also, fluid can leak from the escape route and soak the surrounding earth, and surface structures can be damaged or lose support from that earth.

Some augers have been made with various types of fasteners for linking flighted modular sections together in series in order to bore a hole to a certain depth. Augers have also been formed with various cutting blades designed for enhancing the performance of the auger. For example, augers have been designed with a tip attached to a leading end of the auger in position for orienting the tip for directional drilling. Still other types of augers have been designed to be compact and portable in order to be transported and used to drill a hole in ice for ice fishing.

A more significant design in the prior art augers involves a limitation to the distance that a helical flight extends along an axle. For example, U.S. Pat. No. 2,221,680 to Parrish teaches an auger having a discontinuous flight attached to the outer surface of the drilling axle. Sections of the flight have been removed from the drilling stem in order to reduce friction that is generated by the rotating land, which is the peripheral edge of the flight, contacting the newly formed sidewall of the hole. This auger more efficiently bores holes, because the frictional force resisting the rotation of the auger is reduced along the auger.

The prior art augers are deficient in significant aspects. For example, the prior art augers are almost always made of an electrically conductive material and utilized near active electrical wires, such as around a dwelling foundation. If a buried wire is broken by the auger, electricity may reach the user by conduction through the auger.

Another significant deficiency is that the prior art augers are difficult to repair. A rotating auger typically encounters resistance from gravel, tree roots, rocks, and compact soils. A counterforce from these obstructions on the flight produces torque that may damage the auger, because the leading end of the auger will have ceased or diminished rotation relative to the proximate end, which still has inertia and torque applied by the power source. Once damaged, the typical prior art augers are usually irreparable without significant rebuilding of the working parts. The connector joints in many prior art augers are relatively elaborate structures having concentric interlocking cylindrical parts combined with cross linking fasteners such as nuts, bolts, and screws. The prior art augers would have to undergo extensive rebuilding in a machine shop instead of at the site where the operation is taking place, thereby delaying the hole-forming operation until the auger is repaired or replaced.

Another significant problem with prior art augers concerns their performance during the hole-forming operation. While the flight is rotating in the hole, contact between the cutting blade at the leading end of the flight and the soil is made within the hole. Usually the cutting blade encounters obstructions, such as rocks and tree roots, which resist the rotational force of the cutting blade. When the cutting blade strikes the obstruction, the obstruction usually remains lodged, becoming a fulcrum that rotates the auger within the hole around the obstruction, thereby causing the auger to pivot on the obstruction. As a result, the auger becomes angled in the hole, and the flight cuts into the sides of the hole causing the hole to become oddly shaped.

Another problem is that the prior art augers lack a structural means for maintaining alignment and steadiness of the auger for the entire duration of the hole-forming operation. Once the hole has been formed to a certain depth, the resistance imposed on the auger by the sides of the hole is diminished along the length of the auger. The resistance is at the leading end of the auger, which is in contact with the soil in the hole. The opposite end of the auger at or near the outside of the hole often wobbles in an elliptical or otherwise eccentric pattern if the axis of the auger is not held in a perfectly coaxial relation to the sidewall of the hole. A significant force must be applied on the auger in order to overcome the tendency of the auger to wobble.

The prior art augers are not completely satisfactory for hole-forming operations, especially where the hole is to be substantially horizontal. An auger with structures for overcoming the deficiencies that have been described is needed.

BRIEF SUMMARY OF THE INVENTION

The invention is a tool for boring. The tool has a first shaft for drivingly linking at a first end to a portable machine that rotates, such as a drill. The first shaft defines a longitudinal axis of rotation when the machine rotates the tool.

A second shaft is drivingly linked to the first shaft. The second shaft has a fastener to which a modular auger section can be drivingly linked. A cylindrical collar is mounted radially outwardly of the second shaft and the fastener. An electrical insulator is interposed between the first and second shafts for electrically insulating the shafts from each other. A shear pin is drivingly linked to the shafts for unlinking the shafts upon the application of a predetermined amount of relative torque to the shafts.

Preferably, one or more auger tips and intermediate auger sections are mounted to the tool to form holes of various lengths and/or depths.

Figure 1:
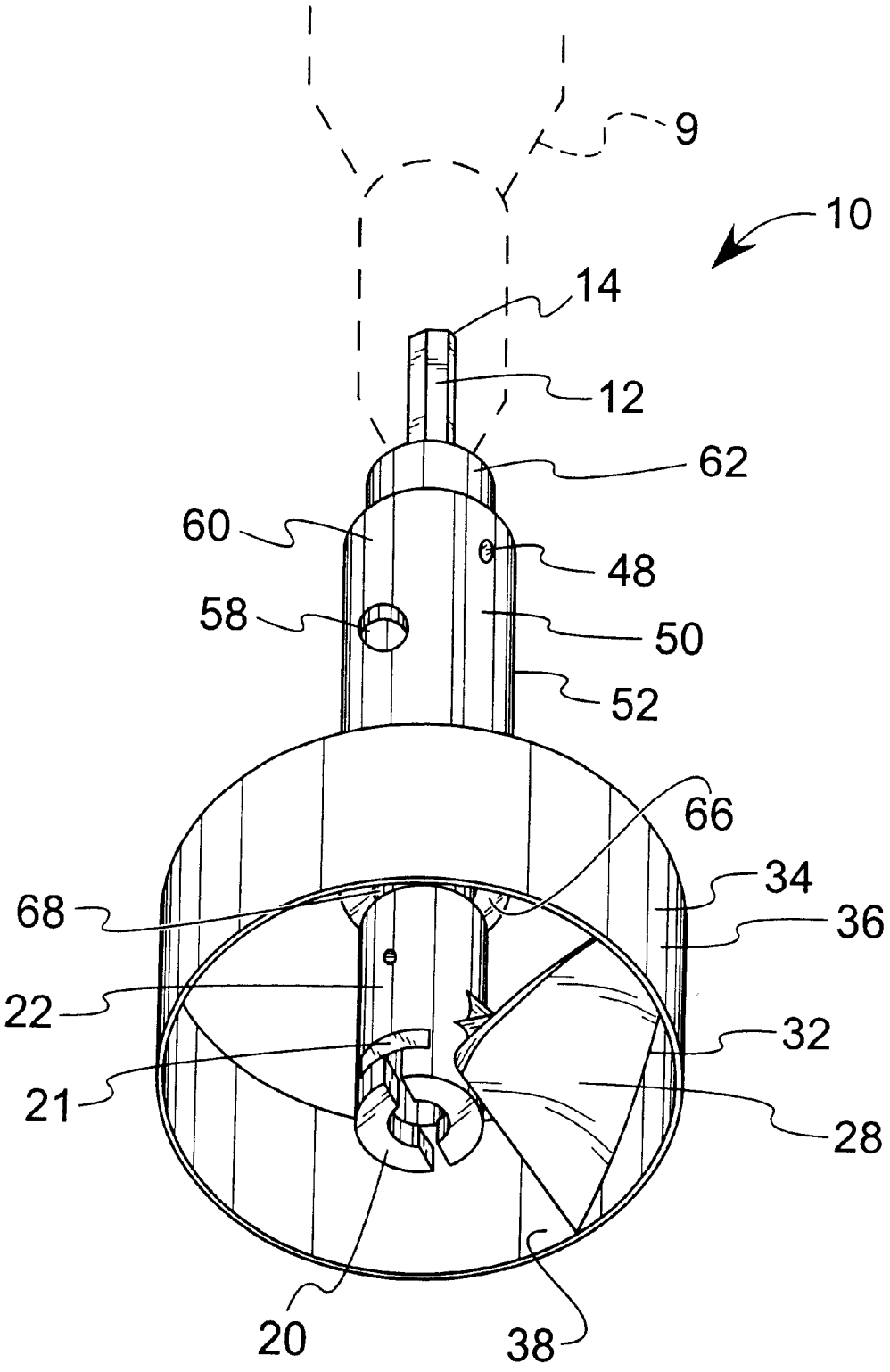
FIG. 1 is a view in perspective illustrating the preferred embodiment for the present invention.

In describing the preferred embodiment of the invention, which is illustrated in the drawings, specific terminology will be resorted to for the sake of clarity. However, it is not intended that the invention be limited to the specific term so selected, and it is to be understood that each specific term includes all technical equivalents that operate in a similar manner to accomplish a similar purpose. For example, the word connected or term similar thereto are often used. They are not limited to direct connection, but include connection through other elements where such connection is recognized as being equivalent by those skilled in the art.

DETAILED DESCRIPTION OF THE INVENTION

Figure 2:
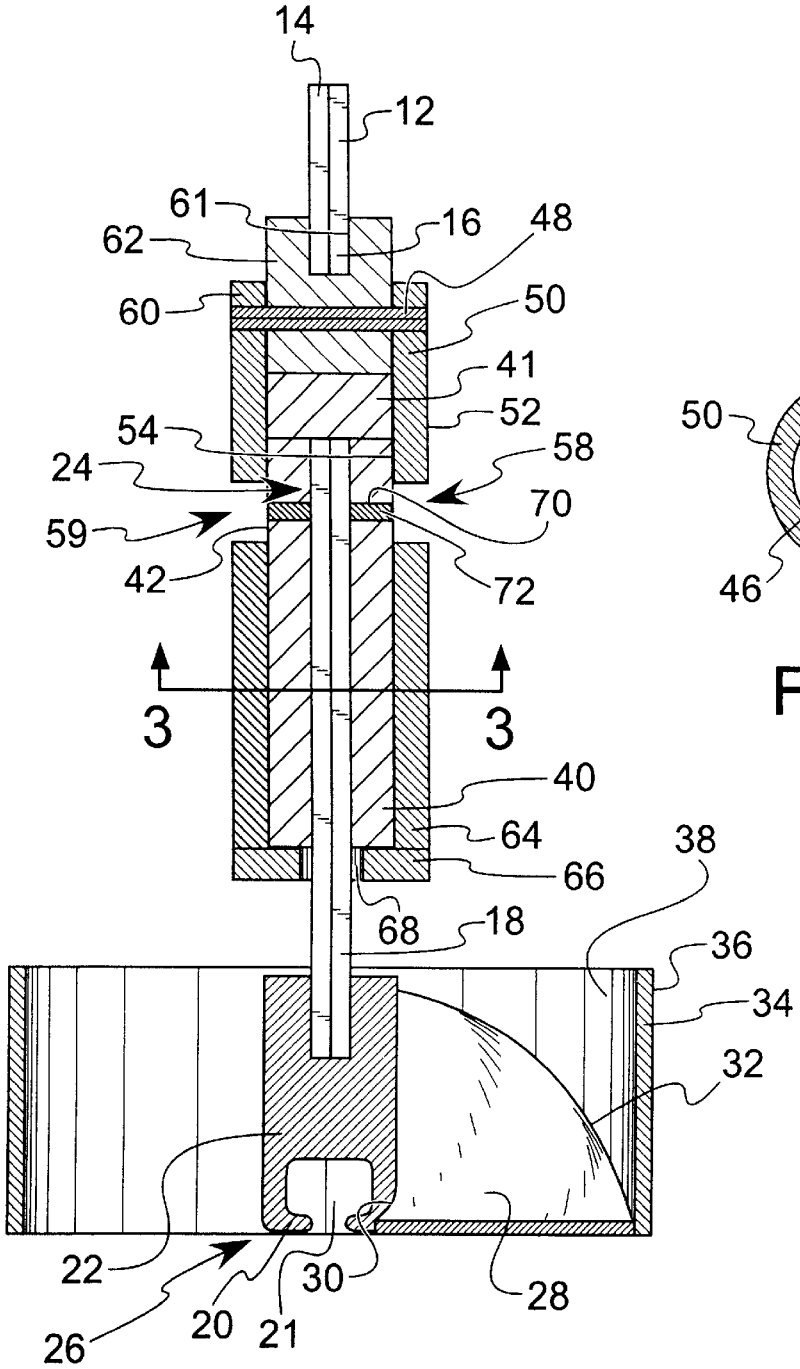
FIG. 2 is a view in section illustrating the preferred embodiment in FIG. 1.
Figure 3:
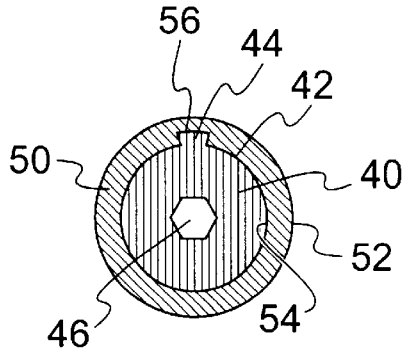
FIG. 3 is a view in section taken along line 3—3 in FIG. 2.

As illustrated in FIGS. 1—3, the invention is an auger tool 10 for boring into soil. The preferred embodiment of the tool 10 has a first shaft 12. The first shaft 12 is preferably a hexagonal rod having a first end 14, a second end 16, and a longitudinal axis that defines an axis of rotation extended through the tool 10, about which the tool 10 can be rotated in a hole-forming operation. The first end 14 is adapted to be drivingly linked to a portable rotatable machine, such as an industrial drill 9, the chuck of which is shown with phantom lines in FIG. 1. The tool 10 is made of steel or similarly rigid material commonly used for making heavy construction implements, unless otherwise noted.

A second shaft 18 is a preferably hexagonal rod that is drivingly linked to the first shaft 12. The second shaft 18 has an upper end 24, a lower end 26, and an outer surface 22. The lower end 26 of the preferred second shaft 18 has a female fastener 20 with an insertion slot 21. The fastener 20 is either integral with the second shaft 18 or a separate piece into which the fastener 20 is formed. A radially inwardly extending edge 30 of a helical flight 28 is attached to the outer surface 22, such as by welding.

A cylindrical collar 34 is mounted radially outwardly of the lower end 26 of the second shaft 18. The cylindrical collar 34 has an outer surface 36 and an inner surface 38. The inner surface 38 is mounted to a land 32 of the helical flight 28, such as by welding. The cylindrical collar 34 extends for about a length of the tool 10 that the land 32 of the helical flight 28 extends, such as three inches. The collar 34 could be between a half inch long to as much as many inches long.

A means for electrically insulating the first shaft 12 from the second shaft 18, such as the insulator 40, is interposed between the shafts 12 and 18. As shown in FIG. 3, the insulator 40 has an outer surface 42 on which a longitudinal key 44 is formed extending substantially the entire length of the insulator 40 into a longitudinal slot 56 formed in the cylindrical housing 50. An elongated cavity 46 extends through the center of the insulator 40, and is occupied by the upper end 24 of the second shaft 18. The cavity 46 is shaped to matingly receive the upper end 24 of the shaft 18 and preferably has a hexagonal cylindrical sidewall. The upper end 24 of the shaft 18 extends through the cavity 46 and abuts an insulating washer 41. The insulating washer 41 is round and made of an electrically non-conductive material, such as nylon.

The preferred insulator 40 is made of a material that is electrically nonconductive and rigid, such as nylon. The insulator 40 is a safety feature, because the hole-forming operation is commonly performed near buried electrical wires. If a wire is struck, the insulator 40 prevents electricity from flowing through the tool 10 and to the drill 9 that the user is holding, as described below.

The cylindrical housing 50 surrounds the insulator 40, and has a top end 60, a bottom end 64, an outer surface 52, and an inner surface 54. The inner surface 54 is in contact with the outer surface 42 of the insulator 40. The longitudinal slot 56 is formed in the inner surface 54 and receives the key 44 that is on the outer surface 42 of the insulator 40.

The bottom end 64 of the cylindrical housing 50 has a cap 66 removably attached thereto. The cap 66 has a hole 68 formed centrally through the cap 66. The hole 68 has a diameter substantially greater than the diameter of the second shaft 18, which extends through the hole 68. This dimensional relationship forms an air gap that is essential in order to prevent electricity from being conducted from the second shaft 18 to the cap 66, and therefore to the housing 50.

The cylindrical housing 50 has a pair of apertures 58 and 59 formed on opposite sides of the housing and extending through the surfaces 52 and 54. The apertures 58 and 59 are aligned oppositely to each other and diametrically across the cylindrical housing 50.

A passage 70 (see FIG. 2) is formed transversally through the insulator 40 and the second shaft 18. The passage 70 is aligned coaxially with the apertures 58 and 59 of the cylindrical housing 50 but has a width that is substantially smaller than the width of each of the apertures 58 and 59. A force-bearing pin 72 is mounted in the passage 70, extending through the insulator 40 and the second shaft 18, but it does not extend substantially past the outer surface 42 of the insulator 40. It is essential that the pin 72 not be positioned in contact with or in close proximity to the cylindrical housing 50 in order to avoid electrical conduction between the pin 72 and the cylindrical housing 50.

The top end 60 of the cylindrical housing 50 has a plug 62. A longitudinal aperture 61 extends partially into the plug 62 and is shaped for matingly receiving the second end 16 of the first shaft 12, such as by having a hexagonal cylindrical sidewall. Welding or a setscrew (not shown) fixedly attaches the second end 16 of the first shaft 12 to the plug 62. The plug 62 extends into the cylindrical housing 50, but does not contact the insulator 40. The insulating washer 41 occupies a gap between the plug 62 and the insulator 40.

A mechanical release means, such as a shear pin 48 or a slip-clutch (not shown), drivingly links the shafts 12 and 18 together. The mechanical release means permits unlinking of the shafts 12 and 18, to allow relative movement of the shafts 12 and 18 when a predetermined amount of relative torque is applied to the shafts 12 and 18. For example, resistance from rocks or compacted soil may abruptly stop the rotating shaft 18. Inertia in the drill 9 causes stress in the form of torsion along the length of the shafts 12 and 18. The stress is relieved when the shear pin 48 or similar mechanical release means breaks or otherwise releases the shafts to move relative to one another. However, the shear pin 48 can be easily removed and replaced at the site of the hole-forming operation and a slip-clutch would easily be re-set. Thus, the shear pin 48 allows the shafts 12 and 18 to be drivingly re-linked at the site of the operation, rather than having to undergo more extensive repairs in a machine shop. A shear pin would be used when abrupt stopping is less likely, and a slip-clutch would be preferred where it is more likely.

The tool 10 is also designed to protect the user against electric shock. If the rotating auger contacts a live conductor, such as a wire, electricity can flow to the second shaft 18. However, electricity cannot flow past the second shaft 18, because although the structures on the tool 10 are drivingly linked together, there are gaps formed by air or nonconductive nylon, in the tool 10 to prevent an electrically conductive link. For example, electricity cannot flow upwardly past the second shaft 18, because the upper portion of the insulator 40 separates the second shaft 18 from the plug 62. The second shaft 18 is still drivingly linked to the insulator 40 by the abutting hexagonal surfaces of the shaft 18 and cavity 46. Thus, electricity is not conducted to the first shaft 12 within the aperture 61 of the plug 62 and to the drill 9.

Likewise, electricity is not conducted from the second shaft 18 across the hole 68 in the cap 66, in order to reach the conductive housing 50 and thus the first shaft 12. The second shaft 18 is drivingly linked to the housing 50 through the hexagonal shaft 18 tightly fitting in the hexagonal cavity 46 of the insulator 40, and the engagement between the key 44 of the insulator 40 in the slot 56.

Finally, electricity cannot flow from the second shaft 18 through the pin 72 and across the apertures 58 and 59, to the conductive housing 50 because of air gaps between the pin 72 and the housing 50. Thus, the tool 10 is designed with structures that are drivingly linked but are not linked in an electrically conductive manner.

Figure 4:
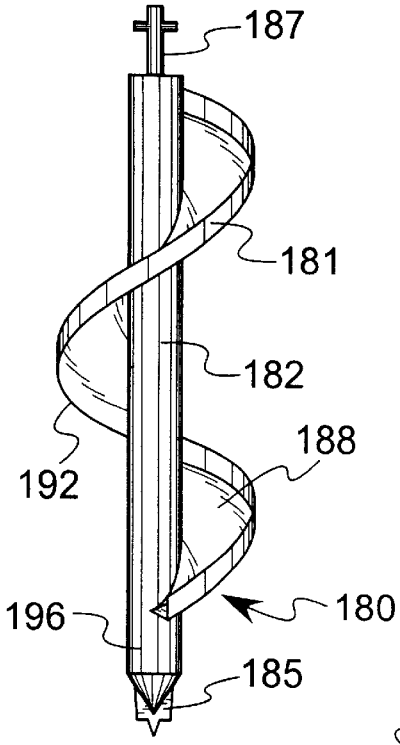
FIG. 4 is a side view illustrating a modular auger tip section.

There are modular auger sections that can be drivingly linked to the tool 10 that is described above. The modular auger sections are designed to be attached to the tool 10 in various combinations to form augers having various lengths and other properties. For example, as shown in FIG. 4, a tip section 180 has a central shaft 182 with a bit 185 at one end. The bit 185 is preferably a conventional paddle drill bit. A male fastener 187 is attached to the central shaft 182 at the opposite end. A flight 188 having a land 192 at its peripheral edge is helically attached at its inner edge to the central shaft 182, such as by welding.

A rim 181 is perpendicularly attached to the land 192. Alternatively, the flight 188 and the rim 181 can be unitarily formed. Preferably, the rim 181 is a thin strip of steel that extends continuously for at least about one revolution of the flight 188 for the purpose described below. However, the rim 181 may extend the entire length of the flight 188 as shown. Alternatively, the rim 181 may be made of discontinuous strips of steel attached at spaced intervals along the land 192 of the flight 188 (not shown).

The flight 188 terminates about two inches, but typically no less than about three-fourths and no more than about four inches, from the bit 185. The section of the central shaft 182 that lacks the flight 188 defines a pilot 196, which has a centering function described below.

Figure 5:
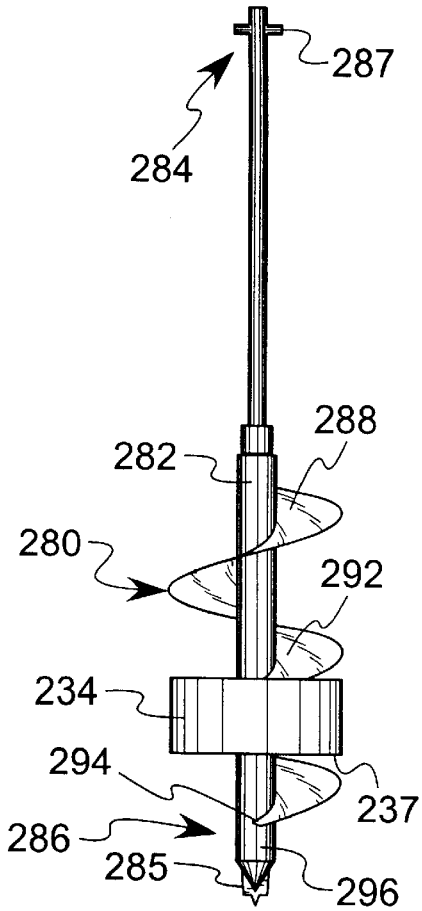
FIG. 5 is a side view illustrating another modular auger tip section.

Looking at FIG. 5, an alternative tip section 280 has a central shaft 282 with a driven end 284 and a leading end 286. The driven end 284 has a male fastener 287, and the opposite leading end 286 has a bit 285. A flight 288 having a land 292 at its peripheral edge is helically attached at its inner edge to the central shaft 282 and has a cutting blade 294 at the end of the flight near the bit 285. The cutting blade 294 is preferably removable to permit sharpening and replacement. The cutting blade 294 sustains most of the wear of the tool, and thus can be made of tool steel or some other wear-resistant material.

A cylindrical collar 234 has a first end 237 that is close to the cutting blade 294 and begins about 2 to 3 inches away from the bit 285. The cylindrical collar 234 is attached to the land 292 of the flight 288, such as by welding, in order to mount the cylindrical collar 234 radially outwardly of the second end 286 of the tip section 280. The cylindrical collar 234 extends for about 2 to 3 inches and has a function described below. The flightless length of the central shaft 282 between the bit 285 and the first edge 237 of the collar 234 defines a pilot 296.

Figure 6:
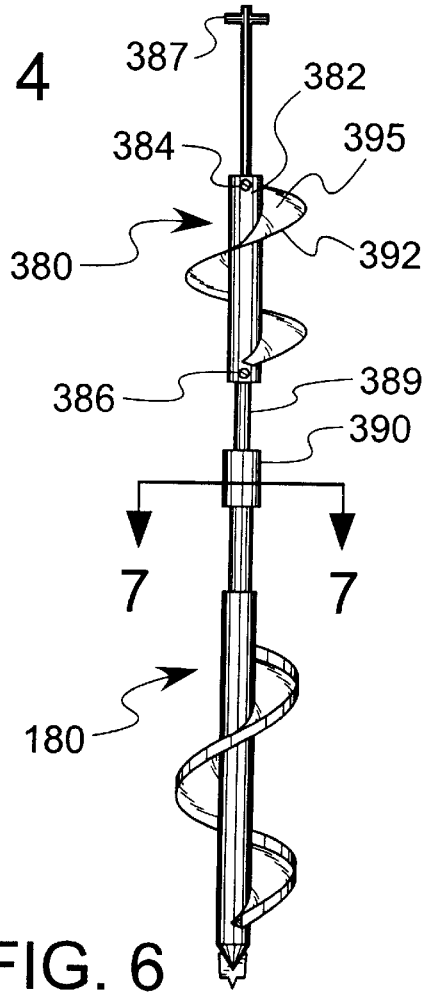
FIG. 6 is a side view illustrating an intermediate modular auger section.

In an alternative embodiment shown in FIG. 6, an intermediate auger section 380 is shown drivingly linked to the tip section 180 of FIG. 4. The intermediate section 380 has an outer shaft 382 slidably mounted to an inner shaft 389. The outer shaft 382 also has a flight 395 with a land 392. A pair of setscrews 384 and 386 fixes the outer shaft 382 to the inner shaft 389, by seating against and frictionally engaging the inner shaft 389 within the outer shaft 382. The outer shaft 382 can thus be adjusted along the length of the inner shaft 389 by loosening the setscrews 384 and 386 and sliding the outer shaft 382 to a desired position, and then re-tightening the setscrews 384 and 386.

Figure 7:
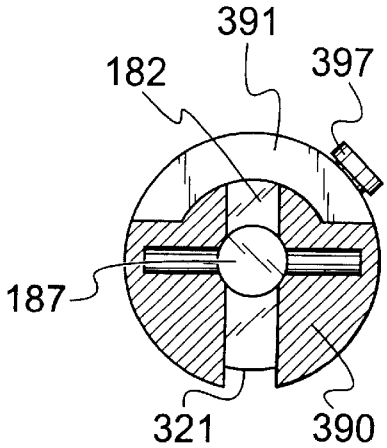
FIG. 7 is a view in section taken along line 7—7 in FIG. 6.

The inner shaft 389 has a male fastener 387 at one end and a female fastener 390 at the opposite end. The female fastener 390, as shown in FIGS. 6 and 7, has a clamp 391 holding the sections 180 and 380 together. The clamp 391 blocks an insertion slot 321 of the female fastener 390, in order to keep a male fastener on the intermediate auger section 380 from moving out of the insertion slot 321 of the tip section 180. Thus, the tip section 180 is kept from separating from the section 380 when the sections 380 and 180 are in use. The clamp 391 is held in position by a screw 397, the head of which seats against the clamp 391.

Figure 8:
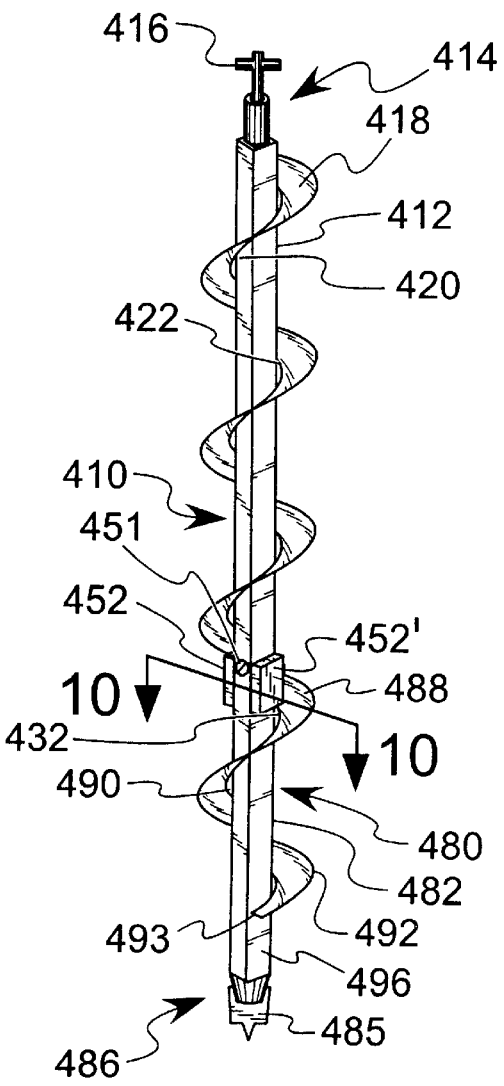
FIG. 8 is a side view illustrating another modular auger tip section linked to an intermediate auger section.

In another alternative embodiment, shown in FIG. 8, an intermediate auger section 410 is drivingly linked to a tip section 480 by a screw 451 and a pair of support plates 452 and 452'. The intermediate auger section 410 has a square cylindrical shaft 412 and has a driven end 414 with a male fastener 416. A flight 418 is attached to the shaft 412 at points where a radially inwardly extending edge 420 of the flight 418 and the outer surface of the shaft 412 meet. The flight 418 extends for substantially the entire length of the shaft 412. Because of the polygonal shape of the shaft 412, a plurality of gaps 422 are formed between the radially inwardly extending edge 420 of the flight 418 and the shaft 412.

The tip section 480 has a central shaft 482, which is square and cylindrical. A leading end 486 of the tip section 480 has a bit 485 and a pilot 496. A flight 488 having a radially inwardly extending edge 432 and a land 492 is attached, such as by welding, to the shaft 482 at points where the edge 432 and the outer surface of the shaft 482 meet. The flight 488 extends helically for substantially the entire length of the shaft 482 to a cutting edge 493. Because of the polygonal shape of the shaft 482, a plurality of gaps 490 are formed between the radially inwardly extending edge 432 of the flight 488 and the shaft 482.

Figure 9:
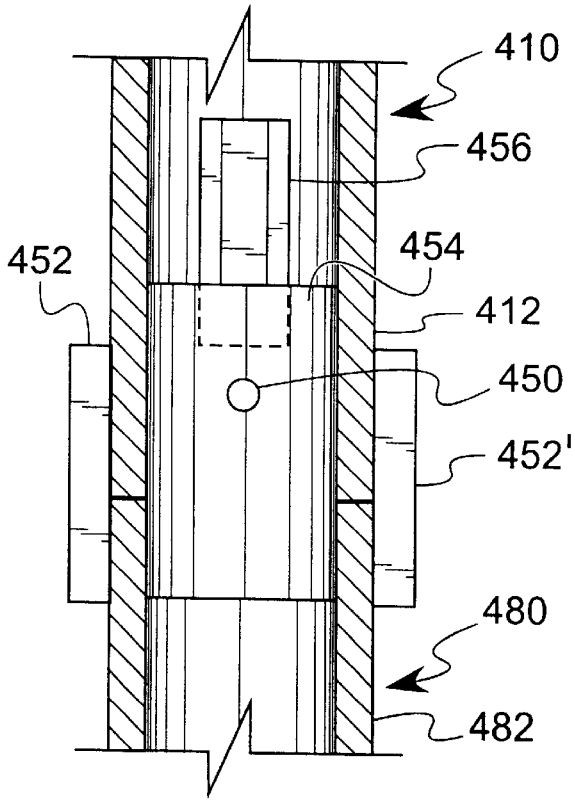
FIG. 9 is a side view in partial section illustrating a fastener linking the sections in FIG. 8.
Figure 10:
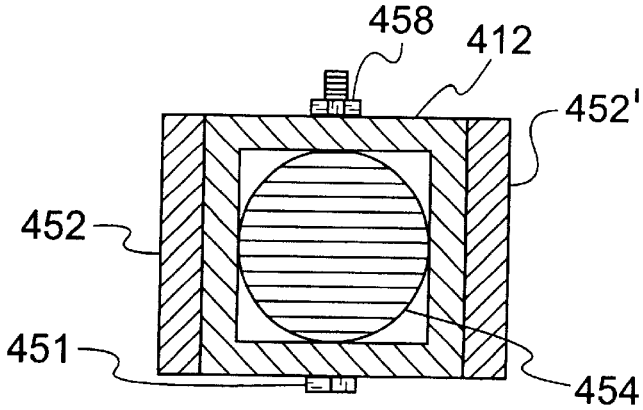
FIG. 10 is a top view in section illustrating the fastener in FIG. 9, taken along lines 10—10 in FIG. 8.

FIGS. 9 and 10 show the link between the sections 410 and 480, including the screw 451 and the support plates 452 and 452'. The shafts 412 and 482 are shown in section for illustrating a rod 454, which is attached substantially permanently to an inner surface of the shaft 482, such as by welding. The rod 454 extends into the shaft 412 of the intermediate section 410 when the two sections are linked. A hexagonal bar 456 is mounted to the rod 454, such as by welding, in a bore extending into the rod 454. In FIG. 9, hidden lines are used to show the end of the hexagonal bar 456 that extends into the bore of the rod 454. The hexagonal bar 456 can be used for mounting the tip section 480 to the chuck of a drill (not shown), as described for the tool 10.

An aperture 450 extends transversely through the rod 454, for receiving the screw 451 that is shown in FIGS. 8 and 10. In FIG. 10, the screw 451 is shown occupying the aperture 450, extending through the shaft 412 and the rod 454. A nut 458 is threaded onto the screw 451 and seats against an outer surface of the shaft 412 for securing the screw 451 in position and securing the sections 410 and 480 to each other.

The plates 452 and 452' are welded on opposite sides of the shaft 412 and are substantially as wide as the shafts 412 and 482. The plates 452 and 452' extend downwardly along the sides of the shaft 482 when the shafts 412 and 482 are linked together. The plates 452 and 452' combine with the screw 451 to drivingly link the shafts 482 and 412 for ensuring there is no relative rotation of the shafts 482 and 412 during operation. The plates 452 and 452' translate the rotational force from the shaft 412 to the shaft 482, by seating against the sides of the shaft 482.

Figure 11:
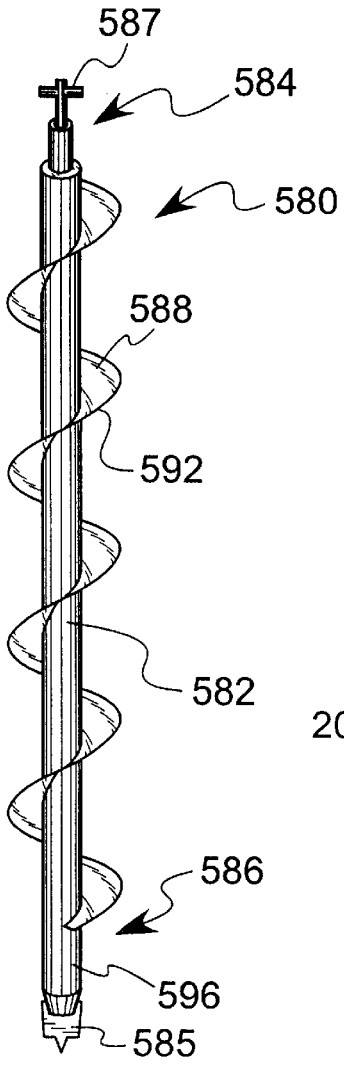
FIG. 11 is a side view illustrating another modular auger tip section.

In another alternative embodiment shown in FIG. 11, a tip section 580 has a circular cylindrical shaft 582. A driven end 584 has a male fastener 587 and an opposite leading end 586 has a bit 585 and a pilot 596. A flight 588 is attached to the shaft 582 and extends helically between the pilot 596 and the driven end 584. The flight 588 has a land 592.

Regarding the use of the tool 10 and one of the tip sections described above, the tool 10 is drivingly linked to the drill 9, the chuck of which is shown with phantom lines in FIG. 1. The drill chuck matingly receives the hexagonal outer surface of the first end 14 of the first shaft 12 and, once tightened, thereby drivingly links the rotary motor of the drill 9 to the first end 14, as is common for tools such as drill bits. Once the tool 10 is in the drill, any one of the tip sections described herein is then attached to the tool 10 for boring. Attachment can be performed prior to or after drivingly linking the tool 10 to the drill 9.

Figure 12:
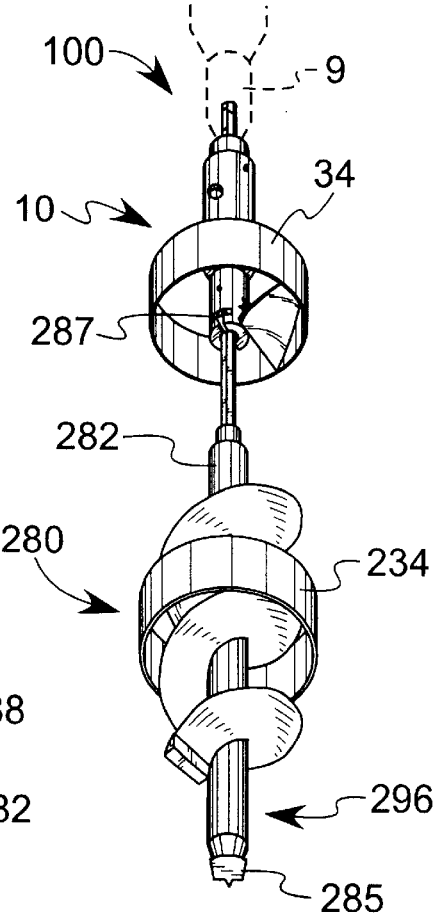
FIG. 12 is a view in perspective illustrating an auger formed with the preferred embodiment in FIG. 1 and the tip section in FIG. 5.

The preferred assembled auger 100 is shown in FIG. 12, and has the tip section 280 drivingly linked to the tool 10. The cylindrical collars 34 and 234 have essentially the same dimensions and are coaxial with the shaft 282. Attachment occurs by guiding the male fastener 287 of the tip section 280 into the insertion slot 21 of the fastener 20 on the tool 10, which are shown in FIGS. 1 and 2. The tip section 280 is then rotated approximately 90° in order to turn the pin of the male fastener 287 past the insertion slot 21. A clamp (not shown in FIG. 12) is preferably, although not necessarily, attached to the female fastener 20 in a position blocking the insertion slot 21. In this way, the male fastener 287 becomes fixed to the female fastener 20, thereby drivingly linking the tip section 280 to the tool 10 and preventing unintended detachment.

Once the auger 100 is assembled, the cutting blade 294 of the tip section 280 is manually placed in contact against a particulate medium, such as sand, dirt, clay, or other soils, for boring. After the cutting blade 294 has contacted the medium, the drill is switched on to simultaneously rotate the tip section 280 and the tool 10 while the user applies a longitudinal force toward the bit 285 in the direction of a hole to be made. The bit enters the medium first, forming a hole the size of the pilot 296. The cutting blade 294 next contacts the medium and initiates the formation of the larger hole by breaking up the medium. As the auger 100 progresses into the medium with the longitudinal axis substantially parallel to the sides of the hole, the bit 285 first extends a small diameter hole into the medium and then the cutting blade extends the main hole. Rotation continues until the auger 100 bores the hole as deep as possible or desired, and the rotary motion of the auger 100 is ceased.

During the boring process, the cutting blade 294 may contact a rock or other obstruction. If the obstruction is not dislodged by the rotational force of the cutting blade 294, the cutting blade 294 seats against the obstruction and stops. The obstruction becomes a fulcrum for the cutting blade 294, which pivots on the obstruction and tends to cause the auger 100 to rotate about the obstruction rather than the auger's axle. A conventional auger in such a situation would be suddenly jolted from its substantially straight path and become angled in the hole. The lands of such an auger would cut into the sides of the hole, thereby slowing or even abruptly stopping the rotary motion of the auger. However, in the preferred embodiment, the pilot 296 and the cylindrical collar 234 of the present invention serve to alleviate this problem by providing blunt surfaces that seat against the soil at the sides of the hole instead of cutting into the soil. Instead, the land 292 is stopped from cutting into the sides of the hole by the blunt surfaces of the collar 234 and the pilot 296, the large surface areas of which seat against the soil rather than cutting into it. The auger 100 thus has an increased potential for dislodging the obstruction, because the cylindrical collar 234 and the pilot 296 provide leverage needed to help the cutting blade 294 stay in its rotary path to move the obstruction.

The cylindrical collar 34 on the tool 10 seats against the soil at the end of the hole where the worker is positioned to eliminate wobbling. The outer surface of the collar 34 rests against the soil at the hole outlet, providing a circular surface to slide continuously against the soil as the auger 100 is rotated.

During the rotation of the auger 100 within the hole, the debris and soil is cut from the soil and removed from the hole by applying an alternating forward and rearward force to the rotating auger 100. The rotating flight pushes the debris and soil from the hole out to the surrounding environment as the auger is displaced into and out of the hole a short distance. The helical flight 28 on the tool 10 pulls the soil from the hole at the hole outlet.

During the first part of the hole-forming operation, the tip section 280 and the tool 10 are connected together and used alone as the auger 100 shown in FIG. 12. Once the hole is as deep as it can be with the auger 100, an intermediate auger section 380, such as described above, can be interposed between the tool 10 and tip section 280. The tool 10 and tip section 280 are disconnected from one another by reversing the order of the steps for connecting the fasteners 20 and 287. The user adds one or more of the intermediate sections 380 between the tip section 280 and the tool 10, by engaging the respective cooperating fasteners. Then the longer auger is inserted back into the hole and begins boring further.

Figure 13:
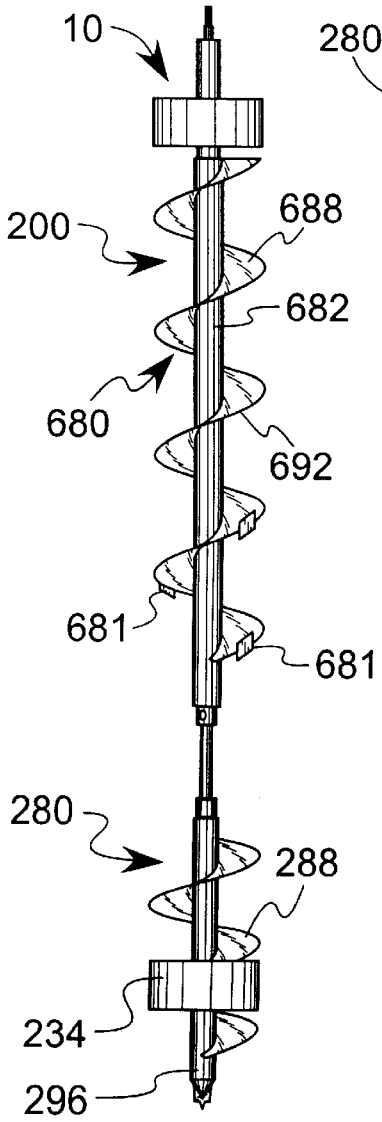
FIG. 13 is a side view illustrating the auger in FIG. 12 formed with an intermediate modular auger section.

As shown in FIG. 13, an auger 200 has an intermediate section 680 drivingly linked to the tool 10 at an upper end. The intermediate section 680 has a central shaft 682 with a cooperating fastener at the opposite, lower end for drivingly linking the section 680 to any one of the tip sections described herein. A helical flight 688 extends for substantially the entire length of the central shaft 682, although the flight 688 may extend for less than the length of, or discontinuously along the length of, the shaft 682. The flight 688 has a land 692 to which a series of rims 681 is perpendicularly attached, such as by welding. The rims 681 collectively produce an effect similar to the continuous rim 181 of FIG. 4. The rims 681 can be attached to the land 692 at regularly spaced or random intervals around the helically extending flight 688.

More than one of the intermediate sections 380 and 680 may be drivingly linked together with the tool 10 and a tip section, but there is a limit to the overall length of any auger. The limit depends on the amount of force that the auger can withstand and the amount of rotating force a machine can provide, and the length of the auger affects the resistance to rotary motion.

While certain preferred embodiments of the present invention have been disclosed in detail, it is to be understood that various modifications may be adopted without departing from the spirit of the invention or scope of the following claims.

What is claimed is:

1. A tool for boring comprising:

a) a first shaft for drivingly linking at a first end to a portable rotatable machine, said first shaft having an axis defining a longitudinal axis of rotation;

b) a second shaft drivingly linked to said first shaft, said second shaft having a fastener to which a modular auger section can be drivingly linked, and an outer surface to which a radially inwardly extending edge of a helical flight is attached;

c) a cylindrical collar having an outer surface and an inner surface, said inner surface mounted to a radially outwardly extending peripheral edge of said helical flight, and said collar mounted radially outwardly of said second shaft;

d) means for electrically insulating said first shaft from said second shaft interposed between the first and second shaft; and e) mechanical release means drivingly linked to said shafts for rotatably unlinking said shafts upon the application of a predetermined amount of relative torque to said shafts.

2. The tool in accordance with claim 1, wherein said means for electrically insulating is a nylon insulator.

3. The tool in accordance with claim 2, wherein said mechanical release means is a shear pin.

4. The tool in accordance with claim 2, wherein said mechanical release means is a slip-clutch.

5. A tool for boring comprising:

a) a first shaft for drivingly linking at a first end to a portable rotatable machine, said first shaft having an axis defining a longitudinal axis of rotation;

b) a second shaft drivingly linked to said first shaft, said second shaft having a fastener to which a modular auger section can be drivingly linked, and an outer surface to which a radially inwardly extending edge of a helical flight is attached;

c) a cylindrical collar having an outer surface and an inner surface, said inner surface mounted to a radially outwardly extending peripheral edge of said helical flight, and said collar mounted radially outwardly of said second shaft;

d) an electrical insulator interposed between the first shaft and the second shaft, insulating said first shaft from said second shaft; and, e) a shear pin drivingly linked to said shafts for rotatably unlinking said shafts upon the application of a predetermined amount of relative torque to said shafts.

6. The tool in accordance with claim 5, wherein said electrical insulator comprises:

a) an electrically insulating body having an outer surface on which a longitudinal key is formed, said key matingly engaged in a longitudinal slot formed on an inner surface of a cylindrical housing that is in surrounding contact with said outer surface of said insulating body;

b) a cavity formed centrally and longitudinally into said insulator, said cavity being occupied by said second shaft;

c) a transverse passage formed through said insulating body and said second shaft, said passage having;

i) a width that is substantially smaller than a pair of aligned transverse apertures formed through said cylindrical housing;

ii) a force-bearing pin mounted in said passage for prohibiting longitudinal movement of said insulating body relative to said second shaft.

7. The tool in accordance with claim 6, wherein said insulating body is nylon.

8. A tool for boring comprising:

a) a first shaft for drivingly linking at a first end to a portable rotatable machine, said first shaft having an axis defining a longitudinal axis of rotation;

b) a second shaft drivingly linked to said first shaft, said second shaft having a fastener to which an auger tip section is drivingly linked, and an outer surface to which a radially inwardly extending edge of a helical flight is attached;

c) a cylindrical collar having an outer surface and an inner surface, said inner surface mounted to a radially outwardly extending peripheral edge of said helical flight, and said collar mounted radially outwardly of said second shaft;

d) means for electrically insulating said first shaft from said second shaft interposed between the first and second shaft; and e) mechanical release means drivingly linked to said shafts for rotatably unlinking said shafts upon the application of a predetermined amount of relative torque to said shafts.

9. The tool in accordance with claim 8, wherein said auger tip section comprises:

a) a central shaft, having:

i) a driven end having a male fastener mounted to the fastener of the tool;

ii) a leading end opposite to said driven end, said leading end having a bit mounted thereto; and, b) a flight, having i) a radially inwardly extending edge helically mounted to said central shaft;

ii) a land at a peripheral edge of said flight;

iii) a cutting blade mounted to an end of said flight near said bit, said flight extending from said driven end and terminating at said cutting blade, wherein a portion of said leading end of said central shaft extending between said bit and said cutting blade and having no flight radially outwardly thereof defines a pilot.

10. The tool in accordance with claim 9, wherein said auger tip section has a rim perpendicularly attached to said land for at least one revolution of said flight.

11. The tool in accordance with claim 10, wherein said rim extends discontinuously along said land of said flight.

12. The tool in accordance with claim 9, wherein said auger tip section has a cylindrical collar mounted radially outwardly of said leading end of said central shaft, said cylindrical collar having a first edge proximate to said cutting blade.

13. The tool in accordance with claim 9, wherein said auger tip section has a square cylindrical central shaft.

14. The tool in accordance with claim 9, wherein said auger tip section has a circular cylindrical central shaft.

15. The tool in accordance with claim 9, further comprising an intermediate auger section drivingly linked between said tool and said auger tip section, said intermediate auger section comprising:

a) an inner shaft having a first end to which a male fastener is mounted and a second end to which a female fastener is mounted;

b) a clamp matingly engaged to said female fastener of said intermediate auger section for locking said tip section to said intermediate auger section; and, c) an outer shaft having a flight helically attached thereto, said outer shaft adjustably mounted to said inner shaft by a pair of setscrews extending through said outer shaft and seating against said inner shaft in frictional engagement.

16. The tool in accordance with claim 9, further comprising an intermediate auger section drivingly linked between said tool and said auger tip section, said intermediate auger section comprising:

a) a central shaft having a first end with a male fastener and a second end with a female fastener;

b) a flight having a peripheral edge with a land and a radially inwardly extending edge mounted to said central shaft, said flight extending between said ends for substantially the entire length of said central shaft; and c) a plurality of rims perpendicularly attached to said land.

17. A tool for boring comprising:

a) a first shaft for drivingly linking at a first end to a portable rotatable machine, said first shaft having an axis defining a longitudinal axis of rotation;

b) a second shaft drivingly linked to said first shaft, said second shaft having a fastener to which an auger tip section is drivingly linked, and an outer surface to which a radially inwardly extending edge of a helical flight is attached;

c) a cylindrical collar having an outer surface and an inner surface, said inner surface mounted to a radially outwardly extending peripheral edge of said helical flight, and said collar mounted radially outwardly of said second shaft;

d) an electrical insulator interposed between the first shaft and the second shaft, insulating said first shaft from said second shaft; and e) a shear pin drivingly linked to said shafts for rotatably unlinking said shafts upon the application of a predetermined amount of relative torque to said shafts.

18. The tool in accordance with claim 17, wherein said auger tip section comprises:

a) a central shaft, having:

i) a driven end having a male fastener mounted to the fastener of the tool;

ii) a leading end opposite to said driven end, said leading end having a bit mounted thereto; and, b) a flight, having i) a radially inwardly extending edge helically mounted to said central shaft;

ii) a land at a peripheral edge of said flight;

iii) a cutting blade mounted to said flight near said bit, said flight extending from said driven end and terminating at said cutting blade, wherein a flightless portion of said leading end of said central shaft extending between said bit and said cutting blade defines a pilot.

19. The tool in accordance with claim 18, wherein said auger tip section has a rim perpendicularly attached to said land for at least one revolution of said flight.

20. The tool in accordance with claim 19, wherein said rim extends discontinuously along said land of said flight.

21. The tool in accordance with claim 18, wherein said modular auger tip section has a cylindrical collar mounted radially outwardly of said leading end of said central shaft, said cylindrical collar having a first edge proximate to said cutting blade.

22. The tool in accordance with claim 18, wherein said modular auger tip section has a square cylindrical central shaft.

23. The tool in accordance with claim 18, wherein said modular auger tip section has a circular cylindrical central shaft.

24. The tool in accordance with claim 18, further comprising an intermediate auger section drivingly linked between said tool and said tip section, said intermediate auger section comprising:

a) an inner shaft having a first end to which a male fastener mounted and a second end to which a female fastener is mounted;

b) a clamp matingly engaged to said female fastener of said intermediate auger section for locking said tip section to said intermediate auger section; and, c) an outer shaft having a flight helically attached thereto, said outer shaft adjustably mounted to said inner shaft by a pair of setscrews extending through said outer shaft and seating against said inner shaft in a frictional engagement.

25. The tool in accordance with claim 18, further comprising an intermediate auger section drivingly linked between said tool and said tip section, said intermediate auger section comprising:

a) an intermediate central shaft having a first end with a male fastener mounted to the fastener of the tool and a second opposite end with a female fastener;

b) a flight having a peripheral edge with a land and a radially inwardly extending edge mounted to said intermediate central shaft, said flight extending between said ends for substantially the entire length of said intermediate central shaft; and c) a plurality of rims perpendicularly attached to said land.

26. A process for boring comprising:

a) drivingly linking a portable rotatable machine to a tool for boring, said tool comprising:

i) a first shaft for drivingly linking at a first end to the portable rotatable machine, said first shaft having an axis defining a longitudinal axis of rotation;

ii) a second shaft drivingly linked to said first shaft, said second shaft having a fastener to which an auger tip section is drivingly linked, and an outer surface to which a radially inwardly extending edge of a helical flight is mounted;

iii) a cylindrical collar having an outer surface and an inner surface, said inner surface mounted to a radially outwardly extending peripheral edge of said helical flight, and said collar mounted radially outwardly of said second shaft;

iv) an electrical insulator interposed between the first shaft and the second shaft, insulating said first shaft from said second shaft;

v) a shear pin drivingly linked to said shafts for rotatably unlinking said shafts upon the application of a predetermined amount of relative torque to said shafts;

b) contacting a cutting blade of said auger tip section to a medium for boring;

c) resting the outer surface of said cylindrical collar on said medium for boring; and, d) rotating the tool while applying a longitudinal force on said tool and said auger tip section.

27. The process in accordance with claim 26, further comprising a step of applying a rearward pulling force on said tool in said hole to remove therefrom an amount of said medium for boring.

28. A tool for boring comprising:

a) a first shaft having a first end and a second end, said first end being drivingly linking to a portable rotatable machine, said first shaft having an axis defining a longitudinal axis of rotation;

b) a second shaft drivingly linked to said first shaft, said second shaft having a first end and a second end, a fastener to which a modular auger section can be drivingly linked, and an outer surface to which a radially inwardly extending edge of a helical flight is mounted;

c) a cylindrical collar having an outer surface and an inner surface, said inner surface mounted to a radially outwardly extending peripheral edge of said helical flight, said collar mounted radially outwardly of said second end of said second shaft and extending substantially parallel to said longitudinal axis of rotation;

d) an electrical insulator interposed between the first shaft and the second shaft for insulating said first shaft from said second shaft, said insulator having i) an electrically insulating body having an outer surface on which a longitudinal key is formed, said key matingly engaged in a longitudinal slot formed on an inner surface of a cylindrical housing in surrounding contact with said outer surface of said insulating body;

ii) a cavity formed centrally and longitudinally into said insulator, said cavity being occupied by the first end of said second shaft;

e) a cylindrical metal housing having:

i) an outer surface, ii) an inner surface, said inner surface being in surrounding contact with said outer surface of said insulator and having a longitudinal slot to which said key of said insulator is matingly engaged, iii) a pair of circular apertures aligned oppositely to each other and diametrically to said housing, each of said apertures having a diameter, iv) a top end having a metal plug attached thereto, said plug having a central aperture in which said second end of said first shaft is matingly attached, v) a bottom end having a cap attached thereto, said cap having a hole that is larger than the diameter of said first end of said second shaft extending through said hole, f) a transverse passage formed through said insulating body and said second shaft, said passage having:

i) a width that is substantially smaller than a pair of aligned transverse apertures formed through said cylindrical housing;

ii) a force-bearing pin mounted in said passage for prohibiting longitudinal movement of said insulating body relative to said second shaft; and, g) a shear pin extending through said housing and said plug, said shear pin drivingly linking said shafts for rotatably unlinking said shafts upon the application of a predetermined amount of relative torque.

* * * * *